350-332 SR
XR 3,947,721
1 P 3104 N

United Stat

Suenami et al.

[11] 3,947,721

[45] Mar. 30, 1976

[54] LIQUID CRYSTAL DEVICE

[75] Inventors: Keniti Suenami, Neyagawa; Kazuhiko Shimizu, Osaka; Kazuo Ogata, Kyoto, all of Japan

[73] Assignee: Matsushita Electric Industrial Company, Ltd., Osaka, Japan

[22] Filed: June 20, 1974

[21] Appl. No.: 481,236

[30] Foreign Application Priority Data

June 22, 1973 Japan ..... 48-75040[U]

[52] U.S. Cl. ..... 315/169 TV; 340/336; 350/160 LC

[51] Int. Cl.[2] ..... H05B 37/00

[58] Field of Search ..... 315/169 R, 169 TV; 340/336; 350/160 LC

[56] References Cited

UNITED STATES PATENTS 3,750,140 7/1973 Gray ..... 350/160 LC 3,803,589 4/1974 Hatsukano et al. ..... 340/336

*Primary Examiner*—R. V. Rolinec
*Assistant Examiner*—Lawrence J. Dahl
*Attorney, Agent, or Firm*—Stevens, Davis, Miller & Mosher

[57] ABSTRACT

A dc rejection circuit is provided between each output of a diode matrix circuit and a corresponding segment electrode in a liquid crystal display panel. The dc rejection circuit may comprise a very simple structure comprising a combination of a resistor and a capacitor thereby providing a liquid crystal display device which is inexpensive and yet ensuring a long service life.

3 Claims, 5 Drawing Figures

3947721
OR IN 315/169TV

LIQUID CRYSTAL DEVICE

This invention relates to a liquid crystal device, and more particularly to a liquid crystal device for displaying a letter, a figure, a mark, etc. by applying an ac signal between a common and segment electrodes of a liquid crystal display panel.

In liquid crystal displays, dc drive, ac drive, quasi-ac drive by pulsed voltage, etc. have been employed for driving display. Among these methods, the dc drive is undesirable from the point of the service life of the liquid crystal elements and therefore is not used except in particular cases.

An object of this invention is to provide a liquid crystal device having a liquid crystal display panel to which an ac signal is applied through a diode matrix circuit and in which dc components generated through the diode matrix circuit is prevented from being applied to the display panel, so that the panel is driven only with ac components and the service life of the same is extended.

Another object of this invention is to provide a liquid crystal display device including a dc rejection or cancelling circuit having an extremely simple structure for removing dc components generated in the diode matrix circuit.

The description will proceed in connection with the accompanying drawings, in which.

Figure 1:
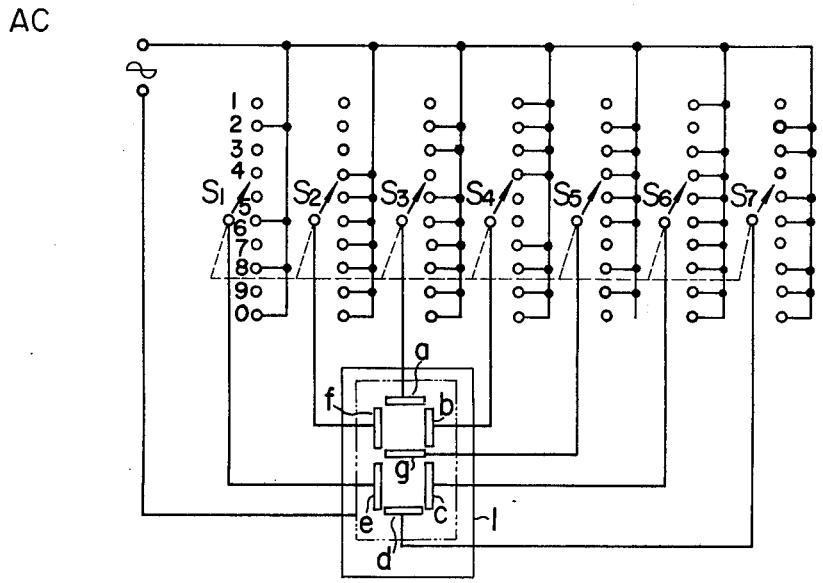
FIG.1 PRIOR ART
FIGS. 1 and 2 are electric circuit diagrams showing conventional liquid crystal display drivers.

A conventional ac drive circuit is shown in FIG. 1, in which interlocked switches $S_1$ to $S_7$ form a matrix circuit for selectively applying an ac voltage to segment electrodes *a* to *g* for indicating a selected figure. In the case of FIG. 1 the numeral "4" is indicated by the segment electrodes with all the interlocked movable contactors positioned on the fixed contacts (4) of the switches. In such cases, the switching structure becomes complicated and expensive.

Figure 2:
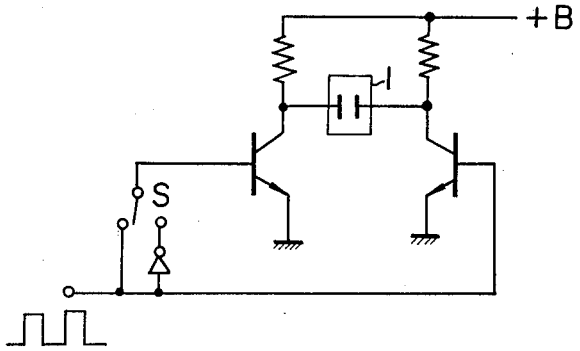
FIG.2 PRIOR ART

FIG. 2 shows a conventional pulse drive circuit which is suitable for integrating switching circuits for achieving complicated displays. Such a circuit becomes expensive when mass-production is not employed.

This invention is intended to remove such drawbacks. An embodiment of this invention will be described referring to FIG. 3.

Figure 3:
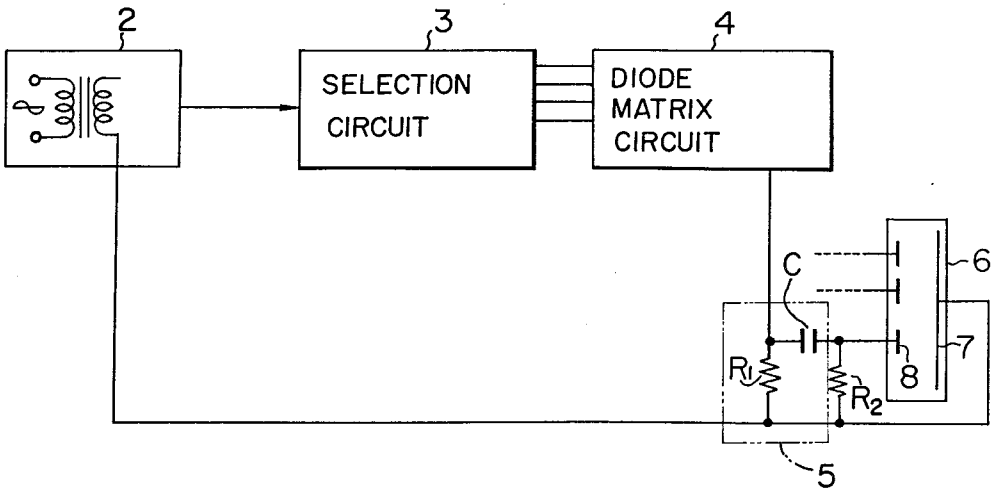
FIG. 3 is an electric circuit diagram showing an embodiment of an ac drive circuit in a liquid crystal display device according to this invention.

In FIG. 3, a voltage source 2 generates an ac voltage or a square wave voltage of duty ratio 1 : 1, which is applied to a display selection switch 3 formed of a simple mechanical switch such as a rotary switch or a push switch. A diode matrix circuit 4 selectively supplies a voltage to respective segment electrodes for achieving a display selected in the selection switch 3. Here, diodes are connected in the same direction. Thus, when an ac voltage is supplied, the output voltage is produced in a half-wave rectified waveform. The current derived from the diode matrix circuit 4 is fed back to the voltage source 2 through a resistor $R_1$ forming a part of a dc rejection circuit 5. A half-wave waveform is generated across this resistor $R_1$. The ac component of this half-wave voltage is picked up through a capacitor C and supplied to a liquid crystal display panel 6. When the resistances of the resistor $R_1$ and a resistor $R_2$ forming a closed circuit with the resistor $R_1$ and the capacitor C are very small compared to the resistance of a segment in said liquid crystal display panel 6 and the relation $R_2 > R_1$ holds, the integration of current flowing through each segment, i.e. the quantity of electricity, becomes zero. In this case, the resistor $R_2$ is not particularly necessary. In the figure, numerals 7 and 8 indicate a common electrode and segment electrodes provided on the inner surface of a pair of glass plates forming the liquid crystal display panel 6.

Figure 4:
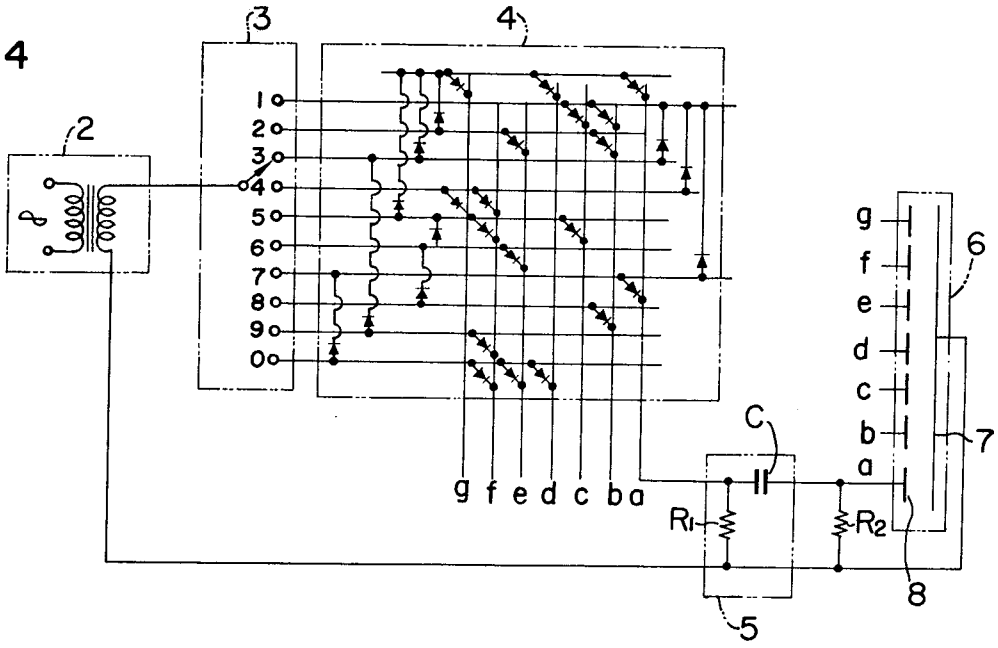
FIG. 4 is a detailed electric circuit diagram of an example of the circuit of FIG. 3.

FIG. 4 shows a concrete example of the circuit of FIG. 3. In the circuit of FIG. 4, an ac voltage signal from a voltage source 2 is applied to a diode matrix 4 through one contact selected in a display selection switch 3 to generate the output voltage at selected output terminals of the diode matrix 4. Output terminals *a* to *g* of the diode matrix circuit 4 are connected to the respective segment electrodes 8*a* to 8*g* of the liquid crystal display panel 6 through respective dc rejection circuits 5. Thus, in FIG. 4 for example, the numeral "3" is indicated by the selected crystal segments connected to the selected output terminals with the one contactor positioned on the fixed contact (3) of the switch 3.

For example, assume that the switch 3 has been placed in position 3 to display the numeral 3 on the liquid crystal display panel 6. The output voltage of the power transformer 2 is supplied through the switch 3 to the "3" terminal of the diode matrix 4. The dots in the diode matrix 4 indicate that the diodes are connected to the corresponding cross points, no electrical connections being made at those points where lines intersect without dots.

During the positive half-cycles of the output voltage across the secondary of power transformer 2, current flows through the diodes so that voltages are developed across the resistors $R_1$ connected to the output terminals *a*, *b*, *c*, *d* and *g* of diode matrix 4. (In FIG. 4, only the resistor $R_1$ connected to terminal a is shown.) During the negative half-cycles of the output voltage across transformer 2, the current is blocked by the diodes and no output voltage appears across the resistors $R_1$. Consequently, half-wave rectified voltage waveforms are produced across the respective resistors $R_1$ connected to terminals a, b, c, d and g, and the AC components of the half-wave rectified voltages are applied through the capacitor C to the resistor $R_2$. Since resistors $R_1$ each have one end connected to the respective segments of the liquid crystal display and their other ends to the common electrode, the AC voltages developed across respective resistors $R_2$ are supplied to the respective segments of the liquid crystal. Accordingly, with the switch 3 placed on position 3, numeral 3 will be displayed on display 6 because segments *a*, *b*, *c*, *d* and *g* will be energized by AC voltages.

Figure 5:
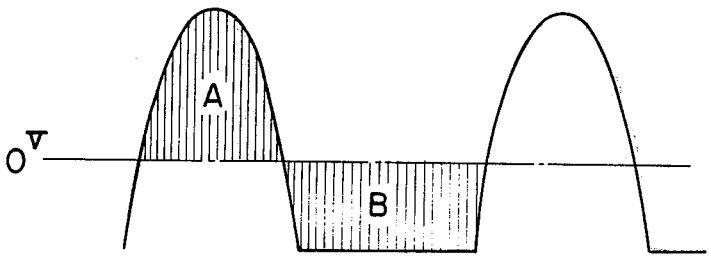
FIG. 5 is a diagram showing the voltage waveform across the resistance $R_2$ of the circuit of FIG. 4.

FIG. 5 shows the waveform across the resistor $R_2$ in the circuit of FIG. 4. Due to the existence of the capacitor C, the half-wave rectified voltage applied across the resistor $R_1$ in the dc rejection circuit 5 becomes a substantial ac voltage of FIG. 5 in which area A = area B.

This invention is featured by applying a substantial ac voltage as shown in FIG. 5 between the common electrode 7 and the segment electrodes 8*a* to 8*g*. Comparing with the case of applying a half-wave rectified voltage, the application of such an ac voltage as in FIG. 5 does not allow charge transfer in the liquid crystal and hence ensures a satisfactory long service life of the liquid crystal display device. Thus the invention provides a very inexpensive display device by the use of liquid crystal display segments together with a single selection switch and diode matrix, said device also ensuring a higher reliability since the mechanically operating part is greatly reduced as compared to the conventional devices such as shown by FIG. 1.

Although the above description describes the case of applying a sinusoidal voltage, any ac voltage such as a square wave, saw-tooth wave, etc. can be used in this invention. The display device of FIGS. 3 to 5 may be advantageously employed as an elevator position indicator or similar device.

What we claim is:

1. A liquid crystal display system comprising:

an AC power source;

a liquid crystal display panel having a common electrode and a plurality of segment electrodes, said segment electrodes being arranged to form desired symbols;

diode matrix means;

selection switch means having a first contact coupled to said AC power source and a plurality of second contacts, each second contact on said selection switch means being coupled through said diode matrix means to said display panel for energization of the segment electrodes of said display panel corresponding to a specific symbol to be displayed, and DC rejection circuit means interposed between said diode matrix means and said display panel, said DC rejection circuit means applying only the AC components of the voltages at the outputs of said diode matrix means across the common electrode and selected segment electrodes of said liquid crystal display panel.

2. A liquid crystal display panel according to claim 1 wherein said DC rejection circuit means comprises a DC rejection circuit for each of the segment electrodes of said liquid crystal display panel, each of said DC rejection circuits comprising a capacitor coupled between a segment electrode and a corresponding output terminal of said diode matrix, and a resistor coupled between said corresponding output terminal of said diode matrix and the common electrode of said display panel.

3. A liquid crystal display panel according to claim 2 comprising a plurality of second resistors, one of said plurality of second resistors being connected between each of said segment electrodes and said common electrode.

* * * * *